US005762214A

United States Patent [19]

Bomgardner

[11] Patent Number: 5,762,214

[45] Date of Patent: Jun. 9, 1998

[54] RAILCAR SHOCK ABSORBER BACKSTOP

[75] Inventor: Charles T. Bomgardner, Burleson, Tex.

[73] Assignee: FM Industries, Inc., Fort Worth, Tex.

[21] Appl. No.: 780,361

[22] Filed: Jan. 9, 1997

[51] Int. Cl.[6] ..... B61G 9/08

[52] U.S. Cl. ..... 213/43; 213/50; 213/64

[58] Field of Search ..... 213/10, 43, 50, 213/61, 64, 65, 69

[56] References Cited

U.S. PATENT DOCUMENTS

| | | | |
|---|---|---|---|
| 3,515,286 | 6/1970 | Powell | 213/43 |
| 3,587,869 | 6/1971 | Atkinson et al. | 213/50 |
| 3,854,596 | 12/1974 | Stephenson et al. | 213/43 |
| 4,113,113 | 9/1978 | Reinhardt et al. | 213/43 |
| 4,261,471 | 4/1981 | Reinhardt et al. | 213/43 |
| 5,571,257 | 11/1996 | Bruski et al. | 213/50 |

OTHER PUBLICATIONS

FMI Drawing 15340 Hydraulic Cushioning Device; Jun. 7, 1993.

FMI Drawing 8–87–15306 Casting–Backstop and Buffstop; Jun. 10, 1976.

*Primary Examiner*—S. Joseph Morano

*Attorney, Agent, or Firm*—James E. Bradley

[57] ABSTRACT

A shock absorber for a railcar locates within a center sill of the railcar. The shock absorber has a housing that moves relative to the center sill. A backstop is welded to the center sill for retaining the piston shaft. The backstop has a top, a bottom and two parallel sides. The height of the backstop from the bottom to the top is substantially less than the center sill. The sides of the backstop are welded to the sidewalls of the center sill in a position which provides an upper clearance between the top of the backstop and the top wall of the center sill and a lower clearance between the bottom of the backstop and the bottom of the center sill.

11 Claims, 2 Drawing Sheets

RAILCAR SHOCK ABSORBER BACKSTOP

BACKGROUND OF THE INVENTION

1. Field of the Invention

This invention relates in general to railcars, and in particular to a backstop which secures a piston shaft of a hydraulic shock absorber to a center sill of the railcar.

2. Summary of the Prior Art

Shock absorbers are employed in railcars to reduce damage to the freight such as automobiles. The railcar has a frame which has a longitudinal center sill. The center sill is an inverted U-shaped channel member located beneath the bed of the railcar. In one type, the center sill is fixed against movement relative to the rail car.

The shock absorber has a housing with a piston which has a shaft protruding out one end. A coupler for coupling to adjacent railcars is mounted to the other end of the shock absorber housing. The housing is carried in the center sill with the coupler protruding from the end of the center sill. The piston has a flange that fits within a backstop which is welded to the center sill. The housing is free to slide relative to the center sill. Shock absorbing fluid, preferably a liquid and gas mixture, is contained within the cylinder of the housing to absorb shock.

The backstop is a metal cast member. In the prior art, it extends the full height of each sidewall of the center sill. The upper side of the backstop is flush with the top of the center sill and the lower side is flush with the open bottom of the center sill. To reduce the weight and amount of metal of the backstop, various cores are formed in the casting. However, the cores make the casting process more complicated and expensive than casting a solid member without cores.

SUMMARY OF THE INVENTION

In this invention, a backstop is utilized which is substantially shorter in height than the prior art backstop. The backstop has a top, a bottom, and two parallel sides. The height of the backstop from the bottom to the top is substantially less than the height of the center sill from the bottom to the top of the center sill. The sides of the backstop are welded to the sidewalls of the center sill in a position which provides an upper clearance between the top of the backstop and the top wall of the center sill. A lower clearance will exist between the bottom of the backstop and the bottom of the center sill.

The backstop, by being shorter in height, need not have any cores to reduce the weight. The only cavity required is the open cavity for receiving the flange of the piston. The sides and back or base of the backstop are smooth flat surfaces.

DETAILED DESCRIPTION OF THE INVENTION

Figure 1:
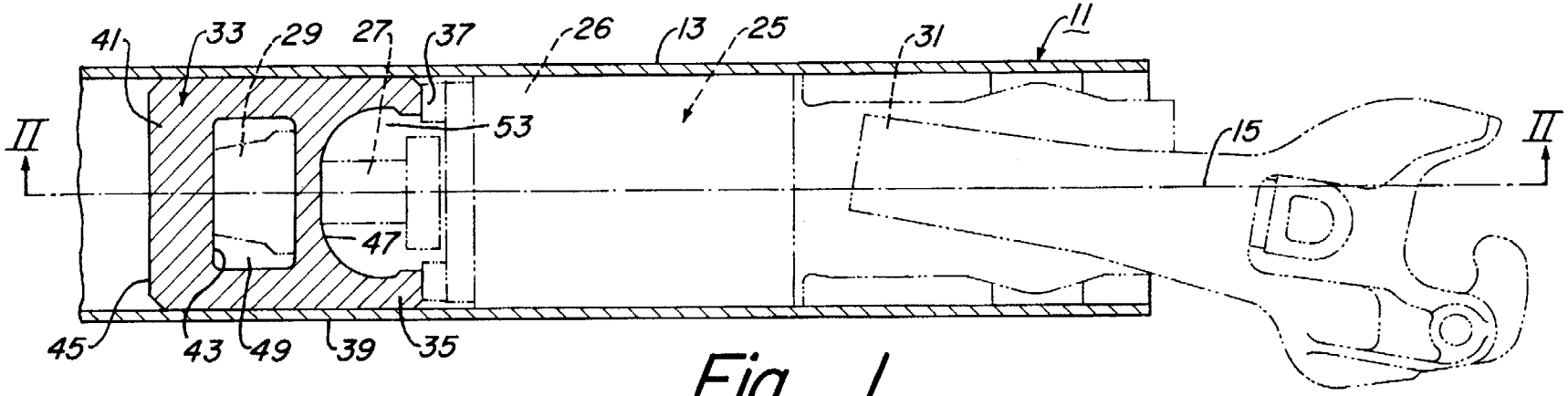
FIG. 1 is a sectional view of a backstop mounted in a center sill in accordance with this invention, and also showing in dotted lines a shock absorber and coupler.
Figure 3:
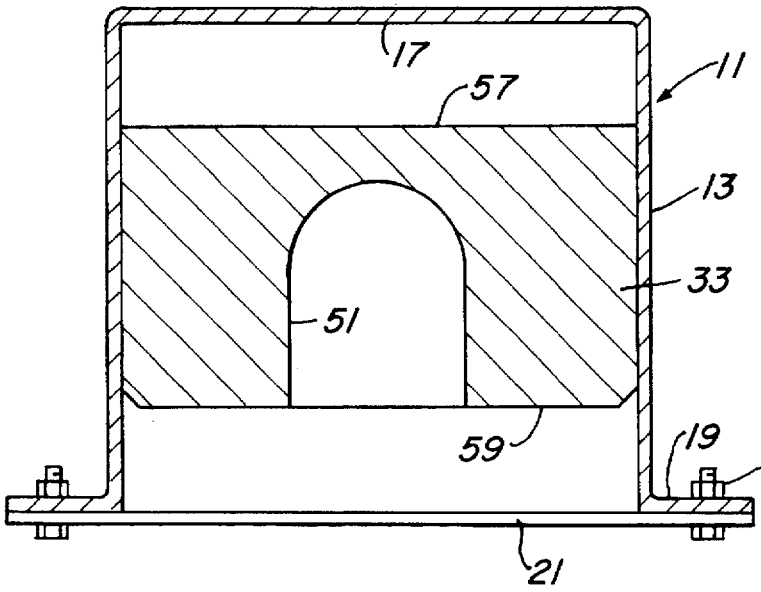
FIG. 3 is a sectional view of the backstop of FIG. 1 taken along the line III—III of FIG. 2.

Referring to FIG. 1, center sill 11 is a large inverted U-shaped beam that extends the length of a railcar. As shown in FIG. 3, center sill 11 has parallel sidewalls 13 which extend along the longitudinal axis 15 of the railcar. Sidewalls 13 extend downward from a top wall 17 which is flat and perpendicular to sidewalls 13. The bottom is open, with the sidewalls 13 terminating in outward turned flanges 19 at the bottom. A carrier plate 21 will be fastened to portions of the bottom by bolts 23 which extend through the flanges 19. Carrier plate 21 supports a shock absorber 25 located therein.

Shock absorber 25 has a housing 26 which contains a compressible fluid, such as oil and compressed nitrogen gas. A piston shaft 27 extends from housing 26 in one direction and has a circular flange 29 its end. A coupler 31 is mounted to the other end of shock absorber 25. Coupler 31 is used to couple the railcar to adjacent railcars. Flange 29 is held stationarily to center sill by a backstop 33. Housing 26 of shock absorber 25 slides relative to piston shaft 27 to absorb shock.

Figure 4:
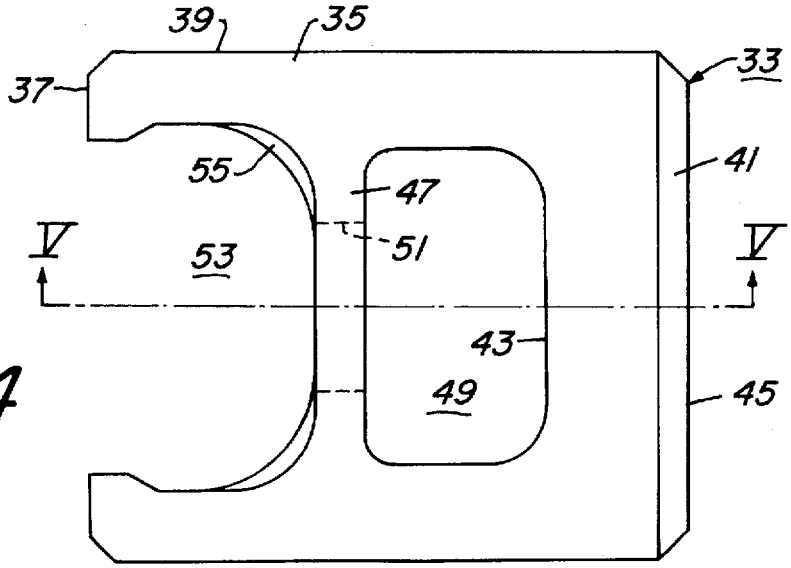
FIG. 4 is a top plan view of the backstop of FIG. 1, enlarged, and shown removed from the center sill.
Figure 5:
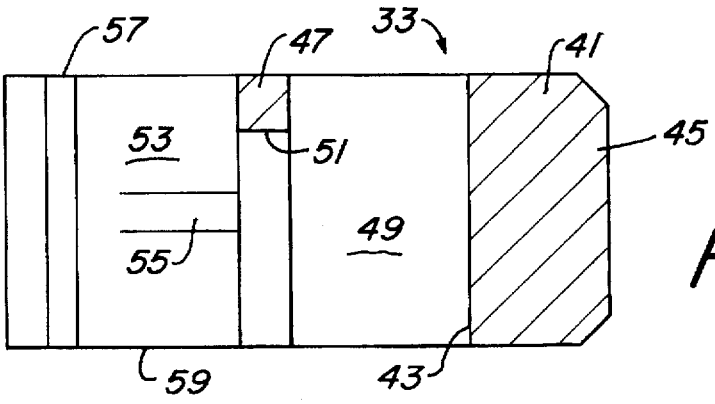
FIG. 5 is a sectional view of the backstop of FIG. 4, taken along the line V—V of FIG. 4.

Referring to FIGS. 4 and 5, backstop 33 is a single integrally cast metal member. Backstop 33 has two legs 35 which extend longitudinally and terminate in free ends 37. Free ends 37 are abutted by housing 26 (FIG. 1) when absorbing extreme buff movement. Free ends 37 are spaced laterally apart from each other. Legs 35 have exterior side surfaces 39 that are smooth and flat and fit substantially flush with the interior sides of sidewalls 13, shown in FIG. 3.

Legs 35 are connected at one end by a base 41 which extends perpendicular to legs 35. Base 41 has an interior end surface 43 which is contacted by piston flange 29 (FIG. 1) during buff movement. Base 41 has an exterior end surface 45 which is smooth, flat and forms an extreme end of backstop 33.

A web 47 extends between legs 35 at a selected distance from free ends 37 and base 41. Preferably, web 47 is located partway between free ends 37 and base exterior end surface 45. Web 47 is a partition that is perpendicular to longitudinal axis 15 (FIG. 1). Web 47 defines a flange cavity 49 between it and base 41. The axial dimension of flange cavity 49 is only slightly greater than the axial dimension of flange 29. Web 47 will be contacted by piston flange 29 (FIG. 1) during draft movement. Web 47 has an opening 51 which has an open bottom for receiving piston shaft 27 (FIG. 1). The upper portion of opening 51 is in the shape of an arc. A larger open space 53 is located between free ends 37 on the side of web 47 opposite flange cavity 49. A pair of strengthening ribs 55 are on the interior sidewalls of legs 35, extending from web 47 toward free ends 37.

Figure 2:
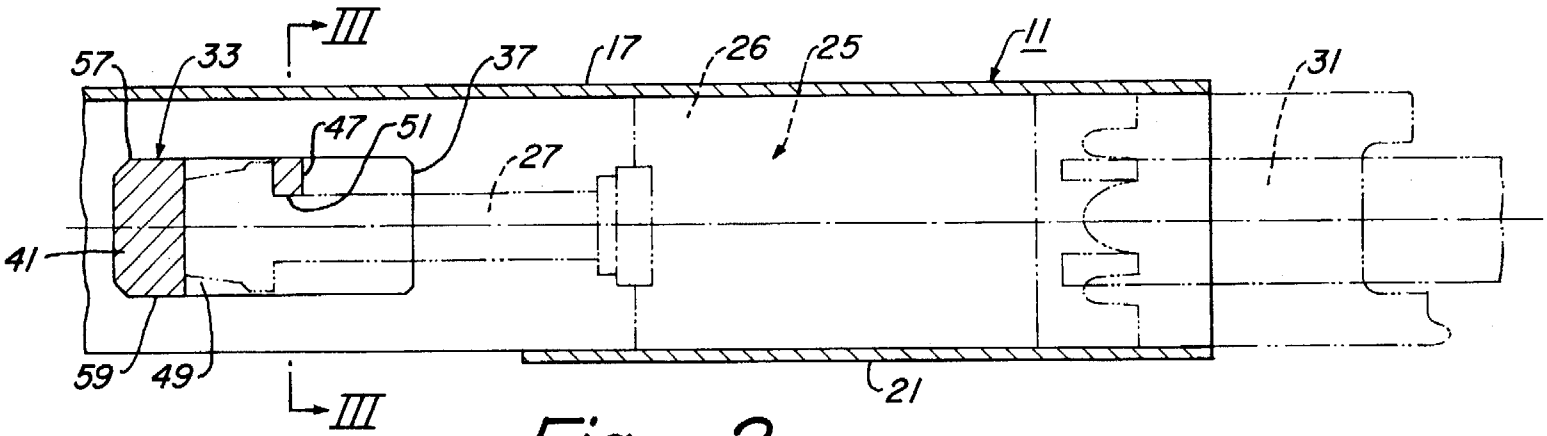
FIG. 2 is a sectional view of FIG. 1 taken along the line II—II of FIG. 1.

As shown particularly in FIGS. 2 and 3, the height of backstop 33 from its upper edge 57 to its lower edge 59 is considerably less than the height of center sill sidewalls 13 from top wall 17 to bottom flange 19. For example, in one embodiment, the height of center sill sidewalls 13 is about 12-½ inches. The height of the backstop 33 from its lower edge 59 to its upper edge 57 is about 7 inches, approximately 56% of the height of center sill 11. Preferably, the height of backstop 33 is in the range from 50% to 60% of the height of center sill 11. Base 41 is substantially thicker than the solid portion of the base of prior art backstops, in one instance approximately three and one-half times as thick.

Backstop 33 is welded to sidewalls 13 in a position that results in a large clearance between top wall 17 and backstop upper edge 57. Similarly, there will be a large clearance between backstop lower edge 59 and the lower edges of flanges 19. These clearances are approximately the same. The center line of shaft 27 (FIG. 1) will locate approximately halfway between upper edge 57 and lower edge 59.

To assemble the shock absorber assembly as shown in FIG. 1, unless previously installed, backstop 33 will be welded to center sill 11. Sidewalls 13 have apertures (not shown) located in them to facilitate welding of sidewalls 13 to the backstop exterior side surfaces 39. Backstop 33 will be welded in a position so that its vertical center line will be coincident with the center line of piston shaft 27.

Then, the operator will lift shock absorber 25 upward into center sill 11. Piston shaft 27 will pass into opening 51, and flange 29 will locate in flange cavity 49. Then, carrier plate 21 will be secured below housing 26 by bolts 23 (FIG. 3). Carrier plate 21 supports the weight of shock absorber 25.

During operation, in a draft movement, housing 26 and coupler 31 will move away from backstop 33. Flange 29 will apply an axial force to web 47. During buff movement, housing 26 and coupler 31 will move toward backstop 33. Flange 29 will transmit an axial force to base interior end surface 43. Piston shaft 27 and flange 29 will remain substantially stationary relative to backstop 33 and center sill 11 during buff and draft movements. During extreme buff movement, a stop surface on shock absorber housing 26 will abut free ends 37.

The invention has significant advantages. Making the backstop shorter in height allows it to be a solid member, free of cores employed for reducing the weight. This reduces the complexity of the casting process and lowers the cost. The improved backstop is also lighter than prior art backstops. The thicker base of the backstop provides greater resistance to bending loads.

While the invention has been shown in only one of its forms, it should be apparent to those skilled in the art that it is not so limited but is susceptible to various changes without departing from the scope of the invention.

We claim:

1. In a rail car having a center sill extending along a longitudinal axis with two parallel sidewalls, a top wall, and an open bottom, an improved coupling and shock absorber assembly comprising in combination:

a backstop having a flange cavity, the backstop having a top, a bottom, and two parallel sides, a height of the backstop from the bottom to the top being substantially less than a height of the center sill from the bottom to the top wall, the sides of the backstop being welded to the sidewalls of the center sill in a position which provides a clearance between the top of the backstop and the top wall of the center sill and a clearance between the bottom of the backstop and the bottom of the center sill;

a shock absorber positioned in the center sill, having a piston shaft extending from one end, terminating in a flange which is retained in the flange cavity of the backstop;

a coupler mounted to an end of the shock absorber opposite the piston shaft for coupling to adjacent rail cars; and a carrier plate releasably secured across the bottom of the center sill to support the shock absorber.

2. The rail car according to claim 1, where the backstop comprises:

a pair of longitudinally extending legs, each having a base end and a free end, each of the legs having an exterior side surface which forms one of the sides of the backstop;

a base which integrally joins the base ends of the legs together, with the free ends being laterally spaced apart from each other, the base being perpendicular to the longitudinal axis and having interior and exterior end surfaces, with the interior end surface of the base defining one end wall of the flange cavity;

a web extending between the legs a selected distance from the free ends and parallel to the base, defining another end wall of the flange cavity; and wherein the exterior side surfaces of the legs are smooth continuous flat surfaces, and the legs are solid members free of any cavities formed therein.

3. The rail car according to claim 1, where the backstop comprises:

a pair of longitudinally extending legs, each having a base end and a free end, each of the legs having an exterior side surface which forms one of the sides of the backstop;

a base which integrally joins the base ends of the legs together, with the free ends being laterally spaced apart from each other, the base being perpendicular to the longitudinal axis and having interior and exterior end surfaces, with the interior end surface of the base defining one end wall of the flange cavity;

a web extending between the legs a selected distance from the free ends and parallel to the base, defining another end wall of the flange cavity; and wherein the exterior end surface of the base is a smooth continuous flat surface which forms an extreme end of the backstop, and the base is a solid member free of any cavities formed therein.

4. The rail car according to claim 1, where the backstop comprises:

a pair of longitudinally extending legs, each having a base end and a free end, each of the legs having an exterior side surface which forms one of the sides of the backstop;

a base which integrally joins the base ends of the legs together, with the free ends being laterally spaced apart from each other, the base being perpendicular to the longitudinal axis and having interior and exterior end surfaces, with the interior end surface of the base defining one end wall of the flange cavity;

a web extending between the legs a selected distance from the free ends and parallel to the base, defining another end wall of the flange cavity; wherein the exterior side surfaces of the legs are smooth continuous flat surfaces, and the legs are solid members free of any cavities formed therein; and the exterior end surface of the base is a smooth continuous flat surface which forms an extreme end of the backstop, and the base is a solid member free of any cavities formed therein.

5. In a rail car having a center sill extending along a longitudinal axis with two parallel sidewalls, a top wall, and a bottom, a shock absorber positioned in the center sill, having a piston shaft extending from one end, terminating in a flange, a coupler mounted to an end of the shock absorber opposite the piston shaft for coupling to adjacent rail cars, and a carrier plate releasably fastened across the bottom of the center sill to support the shock absorber, an improved backstop for stationarily retaining the flange of the piston shaft with the center sill, comprising in combination:

a pair of longitudinally extending legs, each having a base end and a free end, each of the legs having a smooth, flat continuous exterior side surface which extends from a lower edge of the backstop to an upper edge of the backstop, the exterior side surfaces being flush with and welded to the sidewalls of the center sill;

a base which integrally joins the base ends of the legs together, with the free ends being laterally spaced apart from each other, the base being perpendicular to the longitudinal axis and having an interior end surface and an exterior end surface, the exterior end surface being smooth, flat, and continuous and extending from the lower edge of the backstop to the upper edge of the backstop;

a web extending between the legs a selected distance from the free ends and parallel to the base, the web and interior end surface of the base defining a flange cavity in which the flange of the piston shaft is retained; wherein a height of the backstop from the lower edge to the upper edge is substantially less than a height of the center sill from a lower edge to an upper edge of the sidewalls of the center sill; and the legs are welded to the sidewalls of the center sill in a position to provide a substantial clearance between the lower edges of the sidewalls of the center sill and the lower edge of the backstop, and a substantial clearance between the upper edge of the backstop and the top wall of the center sill.

6. The railcar according to claim 5, wherein the legs are solid members free of any cavities formed therein.

7. The railcar according to claim 5, wherein the base is a solid member free of any cavities formed therein.

8. A method of forming and mounting a shock absorber backstop to a center sill of a railcar, the center sill extending along a longitudinal axis, having two parallel sidewalls, a top wall, and an open bottom, comprising:

casting the backstop as a single piece, with a flange cavity for receiving a piston shaft flange of the shock absorber, a top, a bottom, and two parallel legs joined at a base end by a base;

selecting the height of the backstop from the bottom to the top to be substantially less than the height of the center sill from the bottom to the top wall; and welding the sides of the backstop to the sidewalls of the center sill in a position which provides a substantial clearance between the top of the backstop and the top wall of the center sill and a substantial clearance between the bottom of the backstop and the bottom of the center sill.

9. The method according to claim 8, wherein the step of casting the backstop further comprises:

casting the legs of the backstop as solid members free of any cavities.

10. The method according to claim 8, wherein the step of casting the backstop further comprises:

casting the base of the backstop as a solid member free of any cavities.

11. The method according to claim 8, wherein the step of casting the backstop further comprises:

casting the legs of the backstop as solid members free of any cavities; and casting the base of the backstop as a solid member free of any cavities.

* * * * *